US012070111B2

(12) United States Patent
Zöschg

(10) Patent No.: US 12,070,111 B2
(45) Date of Patent: Aug. 27, 2024

(54) U-SHAPED HOLDER DEVICE FOR CARDS AND/OR MONEY

(71) Applicant: Wimex SRL, Laives Bolzano (IT)

(72) Inventor: Elmar Zöschg, Laives Bolzano (IT)

(73) Assignee: WIMEX SRL, Laives (IT)

( * ) Notice: Subject to any disclaimer, the term of this patent is extended or adjusted under 35 U.S.C. 154(b) by 90 days.

(21) Appl. No.: 17/626,839

(22) PCT Filed: Jul. 15, 2020

(86) PCT No.: PCT/EP2020/069951

§ 371 (c)(1),
(2) Date: Jan. 13, 2022

(87) PCT Pub. No.: WO2021/009200

PCT Pub. Date: Jan. 21, 2021

(65) Prior Publication Data

US 2022/0312919 A1 Oct. 6, 2022

(30) Foreign Application Priority Data

Jul. 17, 2019 (IT) ..... 102019000012096

(51) Int. Cl.
*A45C 11/18* (2006.01)
*A45C 1/06* (2006.01)

(52) U.S. Cl.
CPC ..... *A45C 11/182* (2013.01); *A45C 1/06* (2013.01); *A45C 2001/062* (2013.01); *A45C 2001/065* (2013.01); *A45C 2011/186* (2013.01)

(58) Field of Classification Search
CPC ... A45C 11/182; A45C 1/06; A45C 2001/062; A45C 2001/065; A45C 2011/186
See application file for complete search history.

(56) References Cited

U.S. PATENT DOCUMENTS

| | | | | |
|---|---|---|---|---|
| 6,082,422 | A | 7/2000 | Kaminski | |
| 8,667,998 | B1 | 3/2014 | Westrick | |
| 9,681,721 | B2 | 6/2017 | Moon | |
| 2003/0155053 | A1 | 8/2003 | Gray | |
| 2012/0222787 | A1 | 9/2012 | Caron | |
| 2014/0284227 | A1* | 9/2014 | Mayer | A45C 1/06 206/39 |
| 2017/0135452 | A1 | 5/2017 | Kane | |

FOREIGN PATENT DOCUMENTS

| | | |
|---|---|---|
| DE | 3718259 | 12/1988 |
| DE | 202012010412 | 1/2013 |
| EP | 1900299 | 3/2008 |

(Continued)

*Primary Examiner* — Sue A Weaver
(74) *Attorney, Agent, or Firm* — Jacobson Holman PLLC

(57) ABSTRACT

The invention relates to a holding device for cards and/or money, in particular to the use of U-shaped holding devices for credit cards. The invention relates to a holding device (100) for cards, money, or the like, comprising a first plate (101) and a second plate (102) with smaller dimensions than the first plate (101). According to the invention, the second plate (102) lies over the first plate (101) and is connected to the first plate (101) on at least two sides, and the second plate (102) has a region (102*a*) which tapers outwards on one side not connected to the first plate (101).

9 Claims, 3 Drawing Sheets

(56) References Cited

FOREIGN PATENT DOCUMENTS

| | | |
|---|---|---|
| JP | H0586225 | 4/1993 |
| JP | H06113913 | 4/1994 |
| JP | 2006113913 | 4/2006 |
| JP | 2011023554 | 2/2011 |
| WO | WO 2013158524 | 10/2013 |

* cited by examiner

U-SHAPED HOLDER DEVICE FOR CARDS AND/OR MONEY

BACKGROUND OF THE INVENTION

The present invention relates to a holding device for cards and/or paper money, in particular an insert for U-shaped holding devices for credit cards A large number of devices are known which are used as a replacement for wallets, in particular for holding credit cards and/or paper money and for compactly stacking them.

US 2017 013 54 52, for example, describes a compact wallet, designed to have the smallest dimensions for trousers or in other places where stacking cards or money with reduced dimensions is required. The device described in the publication comprises two rigid panels forming a sandwich, each of the panels having a longitudinal extension and at least one elastic band surrounding the two panels by creating an elastic force such that the two panels are pressed together. The elastic band advantageously also encloses an element that the device holds paper money, for example. The system described there has some gaps, in particular it does not hold everything within a closed space and the tape must be added or removed what can be easily lost. An additional element is required for paper money to ensure that it is retained.

From U.S. Pat. No. 8,667,998, a holding device for cards and paper money is known, which is formed by a chamber within which an element is arranged to exert pressure to hold the cards and to fix the paper money in an opening in order to remove the cards out of the chamber. This system is also rather complicated and has considerable disadvantages in handling.

U.S. Pat. No. 6,082,422 also describes a device for holding cards and paper money with a clip for fastening paper money and for exerting pressure on the cards.

A large number of other paper money holders are known from JP H05 86225, EP 1900 299, US 2012/222787, JP H06113913.

From U.S. Pat. No. 9,681,721 a U-shaped device for holding cards is known. In this case it is not possible to hold the paper money and it is also required that the view of the cards is not blocked.

When using a U-shaped device also to carry paper money, it is required that paper money is not visible to third parties, since third parties do not need to know how much paper money one is carrying. It is therefore advantageous to cover the U-shaped frame of the device on at least one side, since it prevents third parties from seeing the cards or the money inside the device. A device may also be provided in the cover to block RFID readers or the like.

SUMMARY OF THE INVENTION

The object of the present invention is to provide a holding device that can be used both for holding paper money and for holding cards and/or as an additional element for other devices, for example cell phone cases and/or card holder devices, in particular in a U-shape.

This object is achieved by a holding device according to the characterizing part of the claims.

The device according to the invention is formed by two rigid card-shaped plates with longitudinal extension, wherein the two plates lying one above the other being connected to one another by an elastomeric polymer partially along at least two sides of the plates and at least one plate advantageously has seats for receiving the polymer and one plate has larger dimensions than the other. This system has the advantage that there is sufficient holding pressure to insert the cards between the two plates and thereby hold back the cards and/or the paper money. The device described can, for example, also be inserted into a preferably U-shaped card holder device, since it can be designed with the same dimensions as a card, for example a credit card, and in this way the holder according to the invention can be easily and quickly added to a known card holder device to hold the paper money. The device described here can also be used on its own as a card and/or paper money and card holder element. In a preferred embodiment, this device can also be used, for example, in connection with a cell phone case or the like in such a way that the case is also converted into a money, paper money and/or card holder device, in particular also for credit cards, identity cards and other cards of similar dimensions, which may be used on a daily base.

Advantageously, elements to block radio signals or other signals such as magnetic signals for reading credit cards, which can contain sensitive data in the chip may be provided in the plates, for example in NFC, RFID or similar chips.

In a preferred embodiment, the holding device has recesses along its outer circumference. These recesses can be designed in such a way that they enable better clamping in a card holding device which can have elements which slide into these recesses and therefore lock the holding element within the device, in particular in the U-shaped device. In this way it is ensured that the element according to the invention, does not emerge unintentionally from a card holder.

A card holding device, in particular for credit cards, identity cards and the like, is therefore also claimed, in which a device according to the invention is used and which has locking elements for the element according to the invention. The card holding device is advantageously formed by a U-shaped frame which can be covered by a flexible cover, for example a leather cover, a cover made of plastic, fabric or other flexible laminates. The U-shaped frame can be formed from metal and/or plastic or another material, for example carbon. The cards can be inserted laterally into the U-shaped frame. The U-shaped frame can advantageously have an elevation at their ends which, according to the invention, allows the device to be clamped. In this way, the device according to the invention can be touched and handled like a credit card and/or the like.

The device according to the invention preferably has smaller dimensions on both sides of the plate that are not connected to the larger dimensions of the surface of the second plate which tapers outwards. This allows paper money and/or cards to be inserted more easily, since there is more space between the two plates in the area of the first insertion, which is then reduced towards the middle and then allows paper money, cards and the like to be clamped between the two plates.

Advantageously, the plate with the smaller dimensions also has an opening, preferably at the corner between the two sides that are connected to the plate of larger dimensions. This opening is advantageously the size of a thumb so paper money or other items can be moved between the two panels in the direction of the corner.

In a preferred embodiment, this opening has an edge to which a plastic layer is attached. In this way, the plastic ensures a better holding of the paper money and/or other things, since it has higher friction.

DESCRIPTION OF THE DRAWINGS

Further features and details of the invention emerge from the patent claims and from the following description of a preferred, non-limiting embodiment shown in the accompanying drawings.

DETAILED DESCRIPTION OF THE INVENTION

Figure 1:
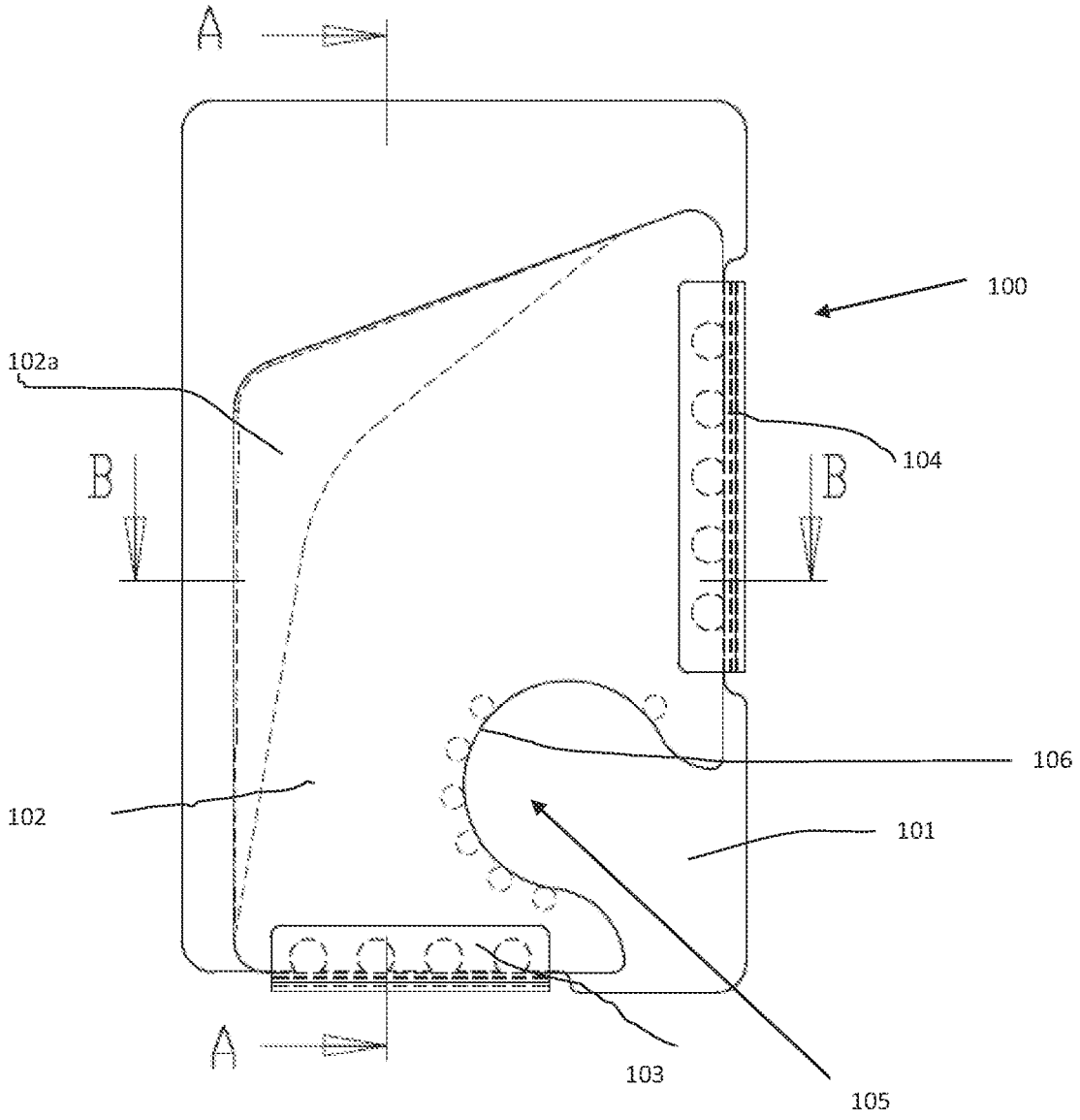
FIG. 1 shows an end view of the device according to the invention.
Figure 2:
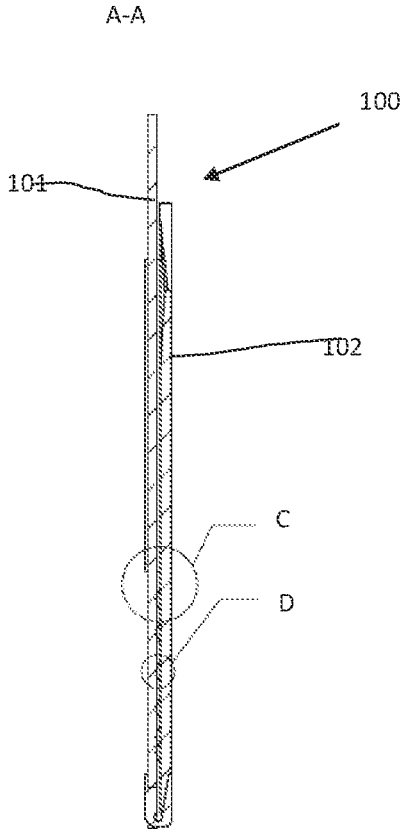
FIG. 2 shows a section A-A from FIG. 1.
Figure 3:
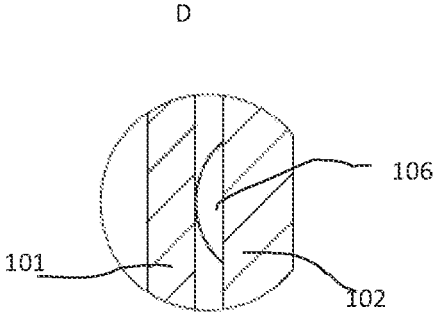
FIG. 3 shows an enlargement D of FIG. 2.
Figure 4:
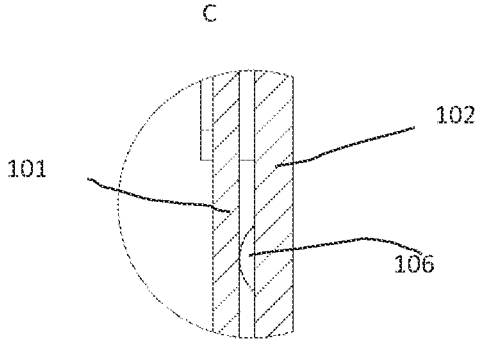
FIG. 4 shows an enlargement C of FIG. 2.

The reference number 100 indicates a holding device according to the invention. The holding device 100 comprises a first plate 101, which advantageously has the same dimensions as a credit card, and a second plate 102 lying on top of the first plate 101. The first plate 101 and the second plate 102 are connected to each other on at least two sides with polymer 103, 104, and both the first and second plates 101, 102 advantageously have openings F in the connection area for better accommodation of the connecting polymer. Advantageously, these openings are circular and/or partially circular and have a side that is open to the outside.

The second plate has a area 102*a* that tapers outward. Advantageously, the two sides of the second plate 102 not connected to the first plate 101 taper outward. In this way, the introduction of paper money, cards or the like between the two plates 101, 102 is facilitated.

An opening 105 is advantageously provided in the second plate 102. This opening 105 has the dimensions of a thumb and is advantageously arranged between the two sides connected to the first plate 101. This opening 105 advantageously allows the paper money, cards or the like, which are contained in the holding device according to the invention, to be adjusted and/or moved between the two plates 101 and 102.

A plastic layer 106 is advantageously attached to the edge of the opening 105. This plastic layer 106 increases the friction of the object introduced between the two plates 101, 102 and the plates. A series of through bores and/or grooves are preferably arranged at the edge of the opening 105 as a receptacle for the plastic 106, preferably a polymer, and thus the first plate 101 is connected to the second plate 102 in a better way.

The plastic 106 advantageously forms an elevation between 0.2 mm and 2 mm on the plate, on which this is advantageously introduced between 0.5 mm and 1 mm. This is particularly advantageous since, during the manufacture of the device 100 according to the invention, a spacer with a thickness between 0.2 mm and 0.5 mm is inserted between the two plates 101 and 102 and, if the attached plastic exceeds 0.5, it produces a pressure also on objects with a minimum thickness such as cards, in particular paper money.

The device 100 according to the invention is advantageously inserted into a card holder or the like, which advantageously has a U-shape that can be closed on one surface by a cover, which can preferably consist of flexible plastic, fabric and/or leather. The device 100 according to the invention is inserted between two opposite legs of the U, wherein the cover being releasable connected to the frame at least on one side; this releasable connection allows the cover to be opened and closed, i.e. is re-closable. The device 100 according to the invention advantageously has recesses which can be coupled to elevations which are provided in the U-shaped holding device. During the insertion of the device 100 according to the invention between the legs of the U, the legs of the U widen and allow the device 100 to be inserted. The free ends of the U-shaped device advantageously have elevations. These elevations allow better holding for the device 100 according to the invention and/or cards or the like inserted into the U-shaped device.

Figure 5:
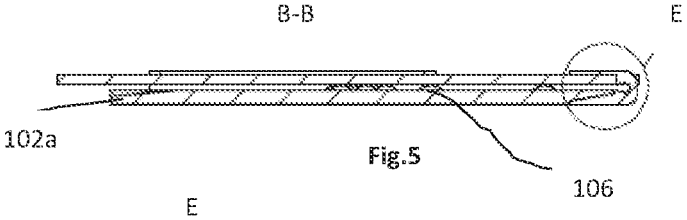
FIG. 5 shows a section B-B from FIG. 1.
Figure 6:
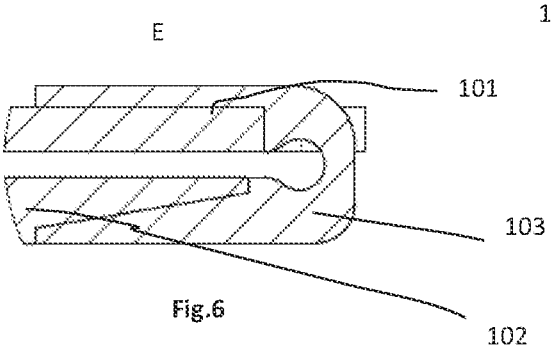
FIG. 6 shows an enlargement E of FIG. 5.
Figures 7, 8, 9, 10:
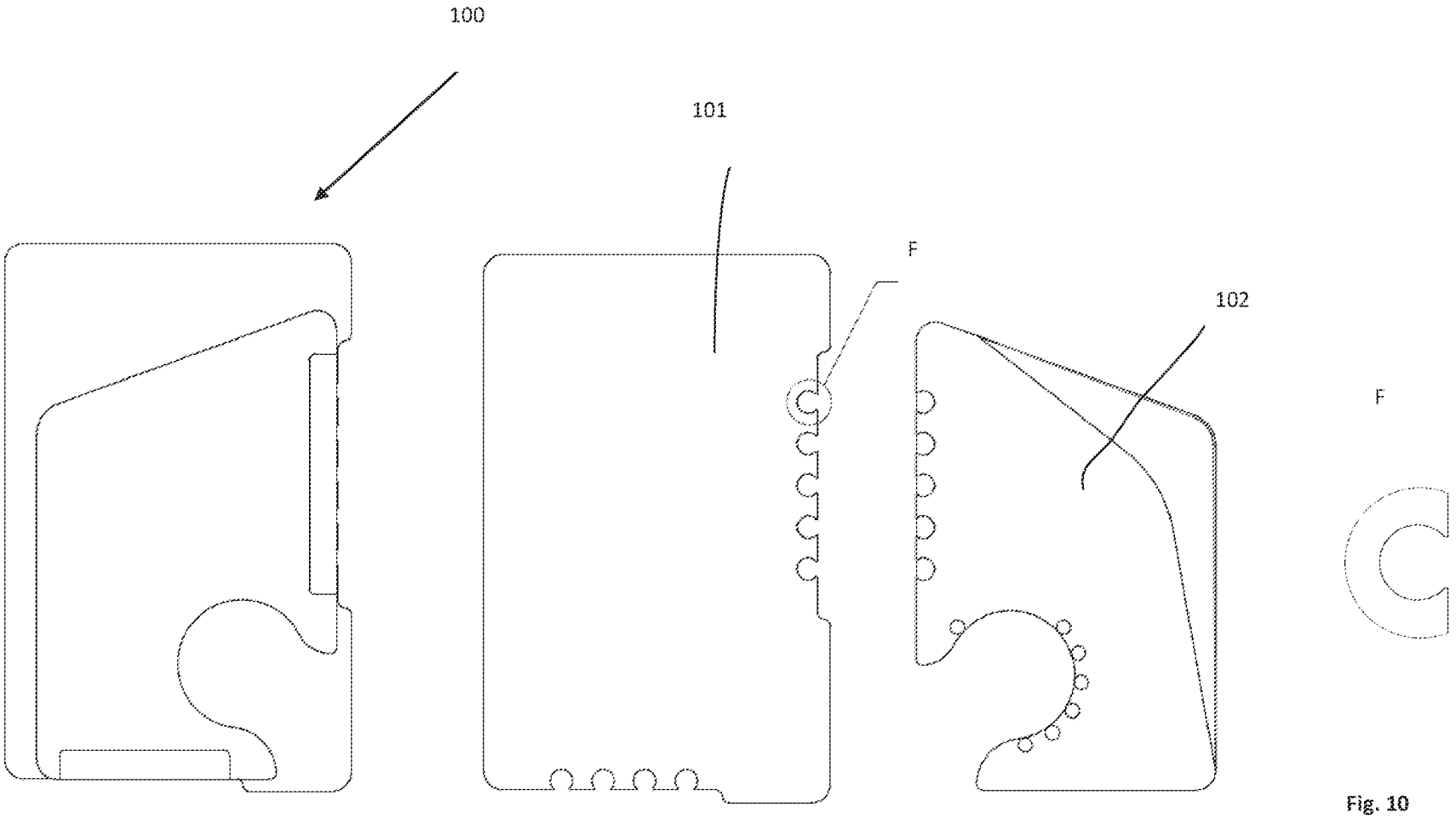
FIG. 7 shows an end view of the device according to the invention.
FIG. 8 shows an end view of the first larger size plate.
FIG. 9 shows an end view of the second smaller size plate.
FIG. 10 shows an enlargement F of FIG. 8.

In FIG. 6, which is enlargement E of FIG. 5, the connection between the first plate 101 and the second plate 102 by plastic 103, preferably a polymer, is explained. This connection 103 advantageously encompasses the two plates from the outside and thus provides the entire space between the plates 101 and 102 for the introduction of cards, paper money and/or cards and the like. The connecting material on sides 103, 104 advantageously has an incision, a seat or the like that can accommodate cards, paper money and/or cards and the like.

Finally, it is clear that what has been described up to now, additions, changes or variants that are self-evident to the person skilled in the art can be made without departing from the scope of protection provided by the appended claims.

LIST OF REFERENCE NUMBERS

100 holding device according to the invention
101 First plate
102 Second plate
102*a* Area tapered from the second plate
103 Polymer for the connection between the first and the second plate
104 Polymer for the connection between the first or the second plate
105 Opening in the second plate
106 Plastic layer on the edge of the opening 105
F Opening

The invention claimed is:

1. A U-shaped card holding device being formed by a U-shaped frame, wherein the U-shaped frame receives a holding device for cards and/or money, the holding device comprising a first plate, a second plate of smaller dimensions compared to the first plate, and the second plate is laying on top of the first plate and is connected to the first plate on at least two sides and the second plate has an area which tapers outward on a side not connected to the first plate and wherein the U-shaped card holding device at its free ends has elevations.

2. The U-shaped card holding device according to claim 1, wherein the U-shaped card holding device is formed from metal.

3. A holding device for cards and/or paper money for a U-shaped card holding device, comprising a first plate, a second plate smaller than the first plate, wherein the second plate is laying on top of the first plate and is connected to the first plate on at least two sides and the second plate has an area which tapers outward on a side not connected to the first plate, wherein the second plate has at least one opening in the area facing away from the tapered and wherein the edge of the at least one opening has a plastic layer.

4. The holding device for cards and/or paper money according to claim 3, wherein the second plate has openings in the connection area between the first and the second plate.

5. The holding device for cards and/or paper money according to claim 4, wherein the openings are circular or partially circular and/or have an outwardly open side.

6. The holding device for cards and/or paper money according to claim 3, wherein the connections between the first plate and the second plate are formed by a polymer.

7. The holding device for cards and/or paper money according to claim 3 the plastic layer has an elevation with a thickness of the plate on which it is attached between 0.2 mm and 2 mm.

8. The holding device for cards and/or paper money according to claim 3, wherein at least one of the plates has an element for blocking waves for triggering RFID chips.

9. The holding device for cards and/or paper money according to claim 3, wherein the connection between the first and second plate surrounds the two plates from the outside and has an incision, a seat to hold cards and/or paper money.

* * * * *